US009431200B2

(12) United States Patent
Choi

(10) Patent No.: US 9,431,200 B2
(45) Date of Patent: Aug. 30, 2016

(54) ELECTROMAGNETIC RELAY

(71) Applicant: LSIS CO., LTD., Anyang-si, Gyeonggi-do (KR)

(72) Inventor: Yeon Soon Choi, Gyeongsangbuk-do (KR)

(73) Assignee: LSIS CO., LTD., Anyang-si (KR)

( * ) Notice: Subject to any disclaimer, the term of this patent is extended or adjusted under 35 U.S.C. 154(b) by 12 days.

(21) Appl. No.: 14/514,039

(22) Filed: Oct. 14, 2014

(65) Prior Publication Data

US 2015/0213981 A1 Jul. 30, 2015

(30) Foreign Application Priority Data

Jan. 27, 2014 (KR) ..... 10-2014-0009919

(51) Int. Cl.

| | |
|---|---|
| ***H01H 67/02*** | (2006.01) |
| ***H01H 50/32*** | (2006.01) |
| ***H01H 51/06*** | (2006.01) |
| ***H01H 50/30*** | (2006.01) |
| *H01H 50/22* | (2006.01) |
| *H01H 50/36* | (2006.01) |

(Continued)

(52) U.S. Cl.

CPC ..... *H01H 50/32* (2013.01); *H01H 50/30* (2013.01); *H01H 51/065* (2013.01); *H01H 50/22* (2013.01); *H01H 50/36* (2013.01); *H01H 50/546* (2013.01); *H01H 50/58* (2013.01)

(58) Field of Classification Search

CPC ..... H01H 50/20
USPC ..... 335/126, 131
See application file for complete search history.

(56) References Cited

U.S. PATENT DOCUMENTS

| | | | | |
|---|---|---|---|---|
| 2,831,938 A * | 4/1958 | Moyer | ..... | H01H 50/22 200/16 A |
| 3,651,437 A * | 3/1972 | Kiyoshi | ..... | H01H 50/22 335/131 |
| 4,644,179 A * | 2/1987 | Pointout | ..... | B60K 28/14 335/126 |

(Continued)

FOREIGN PATENT DOCUMENTS

| | | |
|---|---|---|
| CN | 1969355 | 5/2007 |
| CN | 201608120 | 10/2010 |

(Continued)

OTHER PUBLICATIONS

European Patent Office Application Serial No. 14189010.3, Search Report dated Jul. 30, 2015, 8 pages.

(Continued)

*Primary Examiner* — Alexander Talpalatski
(74) *Attorney, Agent, or Firm* — Lee, Hong, Degerman, Kang & Waimey PC; Jonathan Kang; Justin Lee

(57) ABSTRACT

An electromagnetic relay includes a housing, a fixed contact provided within the housing, a movable contact movable to contact or be separated from the fixed contact, and a driving unit configured to drive the movable contact to be in contact with or separated from the fixed contact, and including a coil, a yoke disposed within the coil and having an inner section for forming a magnetic path inside and outside of the coil, a movable core disposed within the coil to be attractable by the inner section, and a shaft having one end connected to the movable core and another end connected to the movable contact, capable of facilitating an assembling process of a shaft and a movable core by eliminating a welding process.

17 Claims, 8 Drawing Sheets

(51) Int. Cl.
*H01H 50/54* (2006.01)
*H01H 50/58* (2006.01)

(56) References Cited

U.S. PATENT DOCUMENTS 4,801,909 A * 1/1989 Fasola ..... H01H 1/20 335/126
4,825,180 A * 4/1989 Miyaji ..... H01H 51/065 335/126
5,359,306 A * 10/1994 Fasola ..... H01H 51/065 335/126
5,892,194 A * 4/1999 Uotome ..... H01H 1/34 218/68
5,894,256 A * 4/1999 Kobayashi ..... H01H 51/065 290/38 R
6,239,678 B1 * 5/2001 Yamauchi ..... H01H 50/645 335/126
7,852,178 B2 * 12/2010 Bush ..... H01H 51/2209 335/126
8,305,169 B2 * 11/2012 Suzuki ..... F02N 11/087 335/126
8,324,995 B1 * 12/2012 Takahama ..... H01H 51/065 335/131
8,446,239 B2 * 5/2013 Niimi ..... H01H 51/065 335/126
8,674,796 B2 * 3/2014 Ito ..... H01H 1/20 335/126

FOREIGN PATENT DOCUMENTS

| | | |
|---|---|---|
| CN | 102456489 | 5/2012 |
| EP | 0798752 | 10/1997 |
| EP | 1768152 | 3/2007 |
| EP | 2442330 | 4/2012 |
| EP | 2472546 | 7/2012 |
| JP | 2002-042625 | 2/2002 |
| JP | 2004-355847 | 12/2004 |
| JP | 2008-288040 | 11/2008 |

OTHER PUBLICATIONS

European Patent Office Application Serial No. 14189010.3, Search Report dated May 26, 2015, 6 pages.
Japan Patent Office Application Serial No. 2014-230365, Office Action dated Dec. 8, 2015, 3 pages.
The State Intellectual Property Office of the People's Republic of China Application No. 201410828089.0, Office Action dated Jun. 28, 2016, 8 pages.

* cited by examiner

ELECTROMAGNETIC RELAY

CROSS-REFERENCE TO RELATED APPLICATION

Pursuant to 35 U.S.C. §119(a), this application claims the benefit of earlier filing date and right of priority to Korean Application No. 10-2014-0009919, filed on Jan. 27, 2014, the contents of which are all hereby incorporated by reference herein in its entirety.

BACKGROUND OF THE INVENTION

1. Field of the Invention

The present invention relates to an electromagnetic relay, more particularly to an electromagnetic relay which is capable of facilitating an assembling process and reducing a production cost.

2. Description of the Conventional Art

As is well known in the art, an electromagnetic relay is a device to open and close a main power supply side circuit and a load side circuit.

FIG. 1 is a sectional view illustrating an electromagnetic relay in accordance with a conventional art, and FIG. 2 is an exploded view illustrating a main part of FIG. 1.

As shown in FIGS. 1 and 2, the conventional electromagnetic relay includes a contact part 10, and a driving part 30 configured to open and close the contact part 10.

The contact part 10 includes a housing 11, a fixed contact 15 fixedly disposed at the housing 11, and a movable contact 21 configured to be in contact with or separated from the fixed contact 15.

The driving part 30 includes a coil 41, a yoke 51 disposed around the coil 41 to form a magnetic path, a fixed core 61 disposed within the coil 41, a movable core 71 disposed to be close to or be separated from the fixed core 61, a shaft 81 having one end connected to the movable core 71 and another end connected to the movable contact 21, and a restoration spring 91 configured to restore the movable core 71 to an initial position.

The coil 41 includes a bobbin 45.

The fixed core 61 is inserted into the bobbin 45.

The fixed core 61 is connected to the yoke 51 to form a magnetic path.

The shaft 81 is inserted into the fixed core 61 so as to be relatively movable with respect to the fixed core 61.

The movable contact 21 is connected to one end of the shaft 81 so as to be relatively movable with respect to the shaft 81.

A compression spring 25, configured to apply pressure against the movable contact 21 to elastically contact with the fixed contact 15, is provided at an end of the shaft 81. An insertion portion 73 is provided in the movable core 71 so that an end of the shaft 81 may be inserted therein.

The shaft 81 is made of metal.

The movable core 71 and the shaft 81 are integrally coupled to each other by welding.

However, in such a conventional electromagnetic relay, when the movable core 71 and the shaft 81 are coupled to each other by welding, a lot of time and effort are required.

Further, it is difficult to identify whether the welding part has any defect or not by the naked eye, after the shaft 81 and the movable core 71 have been welded to each other.

Further, an additional device (for example, a jig for adjusting a stroke) is required to maintain a stroke between the fixed core 61 and the movable core 71 as a predetermined gap, thereby increasing a working time and requiring additional facilities.

SUMMARY OF THE INVENTION

An object of the present invention is to provide an electromagnetic relay which is capable of facilitating an assembling process and reducing a production cost.

Another object of the present invention is to provide an electromagnetic relay which is capable of facilitating an assembling process by eliminating a welding process when coupling the shaft and the movable core.

A further object of the present invention is to provide an electromagnetic relay which is capable of reducing additional facilities and production cost when coupling the shaft and the movable core.

To achieve these and other advantages and in accordance with the purpose of this specification, as embodied and broadly described herein, there is provided an electromagnetic relay, including a housing; a fixed contact provided within the housing; a movable contact movable to contact or be separated from the fixed contact; and a driving unit configured to drive the movable contact to be in contact with or separated from the fixed contact, wherein the driving unit comprises a coil; a yoke disposed within the coil and having an inner section for forming a magnetic path inside and outside of the coil; a movable core disposed within the coil to be attractable by the inner section; and a shaft having one end connected to the movable core and another end connected to the movable contact.

The shaft may include a shaft body and a coupling portion provided at an end of the shaft body and coupled with the movable core.

The electromagnetic relay may further include a fixing member coupled to an end of the coupling portion which is exposed to outside of the movable core and configured to restrict separation of the coupling portion from the movable core.

The electromagnetic relay may further include a hook provided at an end of the coupling portion and a hook locking jaw engaged with the hook in an axial direction provided at the fixing member.

The coupling portion may include a first diameter section extended from an end of the shaft body, a second diameter section formed at one side of the first diameter section and having a smaller diameter than the first diameter section, and a hook locking jaw accommodating portion formed at one side of the second diameter section, and configured to accommodate therein the hook locking jaw.

The hook locking jaw may be configured to be elastically transformed when the hook is coupled thereto.

The fixing member may include a cylindrical fixing member body, and wherein the hook locking jaw may be provided in plurality in number and disposed within the fixing member body in a circumferential direction.

Each of the shaft and the movable core may include an engaging portion to restrict an exposed range of the hook.

The engaging portion may include a hooking portion provided at the shaft, and a hooking jaw provided at the movable core and configured to be engaged with the hooking part in an axial direction.

The hook locking jaw may include a hook accommodating portion to accommodate therein the hook.

The fixing member body may include a through hole for communicating with the hook accommodating portion.

The movable core may include a fixing member insertion portion configured to insert the fixing member therein.

The fixing member body may include a flange extended outward in a radius direction.

The shaft may be made of a synthetic resin material.

The movable contact and the shaft may be connected to each other so as to be relatively movable with each other, and the shaft may include a compression spring applying an elastic force to the movable contact for elastic contact with the fixed contact, and the shaft may include a compression spring support portion for supporting the compression spring.

The shaft may include a space portion formed by cutting out or removing part of the shaft.

The yoke may include a first yoke disposed outside the coil to form a magnetic path and a second yoke including a connection section configured to connect the inner section to the first yoke.

A restoration spring may be provided between the inner section of the second core and the movable core so as to return the movable core to its initial position, and the inner section may include a restoration spring support portion for supporting an end of the restoration spring.

The inner section may include a cylindrical portion having a receiving space therein and a shielding portion for shielding an end of the cylindrical portion, and the restoration spring support portion may be formed on the shielding portion in a concaved manner.

The first yoke may be formed in a U-shape, and may include a shielding portion disposed on an end of the coil in an axial direction, and side wall portions bent from two ends of the shielding portion and disposed at an outer circumferential surface of the coil.

BRIEF DESCRIPTION OF THE DRAWING

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENT

Hereinafter, a preferred embodiment of an electromagnetic relay according to the present invention will now be described in detail with reference to the accompanying drawings.

Figure 1:
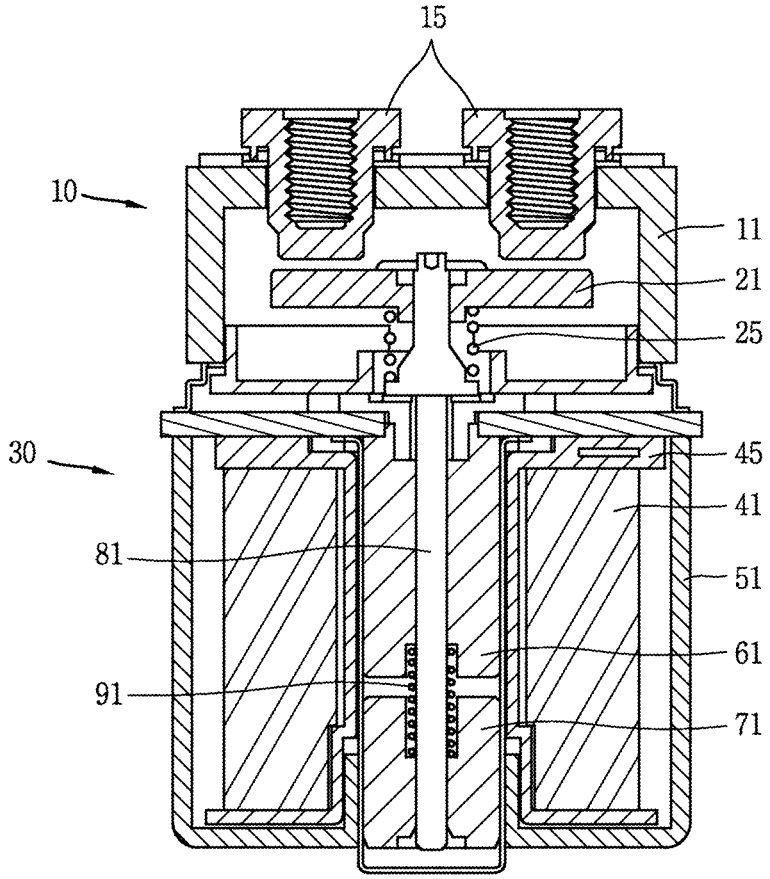
FIG. 1 RELATED ART
FIG. 1 is a sectional view illustrating an electromagnetic relay in accordance with the conventional art.
Figure 2:
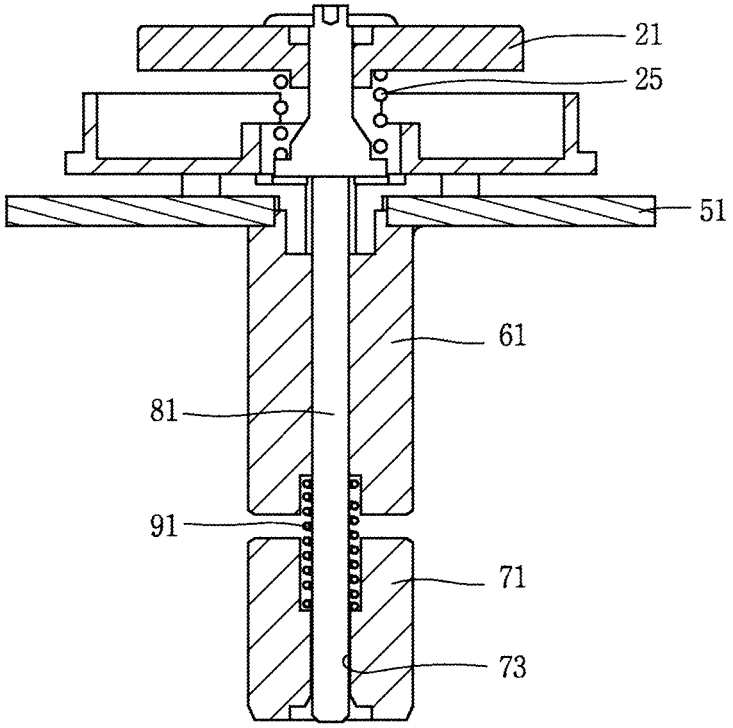
FIG. 2 RELATED ART
FIG. 2 is an enlarged view of a main part of the electromagnetic relay in accordance with the conventional art.
Figure 3:
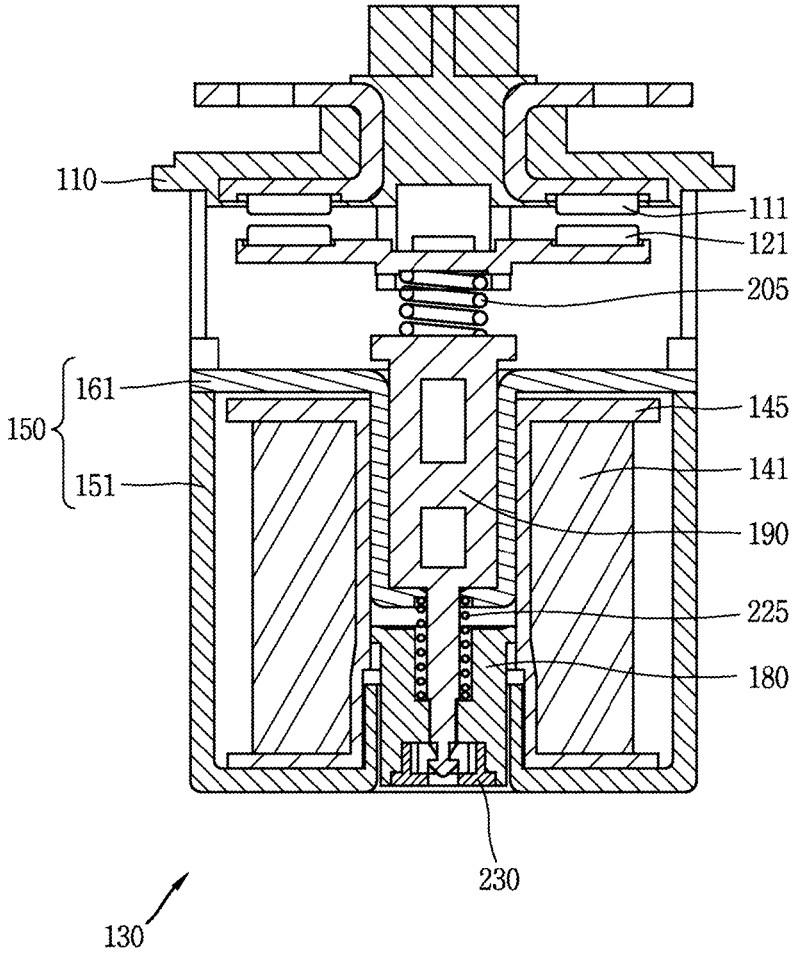
FIG. 3 is a sectional view illustrating an electromagnetic relay in accordance with an embodiment of the present invention.

As shown in FIG. 3, an electromagnetic relay according to an embodiment of the present invention comprises a fixed contact 111, a movable contact 121 disposed to be contactable to the fixed contact 111, and a driving unit 130 configured to drive the movable contact 121 to contact or be separated from the fixed contact 111.

The driving unit 130 includes a coil 141, a yoke 150 disposed within the coil 141 and having an inner section 162 to form a magnetic path therein, the yoke 150 forming a magnetic path inside and outside of the coil 141, a movable core 180 disposed within the coil 141 to be attractable through the inner section 162, and a shaft 190 having one end connected to the movable core 180 and another end coupled to the movable contact 121.

The electromagnetic relay may include a housing 110 having an accommodating space therein.

The fixed contact 111 may be fixed to the housing 110.

The movable contact 121, which is movable to contact or be separated from the fixed contact 111, may be provided within the housing 110.

The movable contact 121 may be configured as a pair of movable contacts which are spaced apart from each other.

The movable contact 121 may include a connection portion 123 made of an electrically conductive material.

The connection portion 123 may include a through hole 125 through by which the shaft 190 is coupled in a relative movable manner.

The driving unit 130, configured to drive the movable contact 121 to contact or be separated from the fixed contact 111, may be provided at one side of the movable contact 121.

The driving unit 130 may be provided at a lower side of the housing 110.

The driving unit 130 may include a coil 141 to form a magnetic path when a power is applied thereto.

The coil 141 may be provided in a cylindrical shape.

The coil 141 may include a bobbin 145.

The bobbin 145 may be provided in a cylindrical shape.

The yoke 150 may be provided around the coil 141 to form a magnetic path.

The yoke 150 may include a first yoke 151 disposed outside the coil 141 to form a magnetic path, and a second yoke 161 having an inner section 162 disposed within the coil 141 to form a magnetic path and a connection section 170 connecting the inner section 162 to the first yoke 151.

Figure 4:
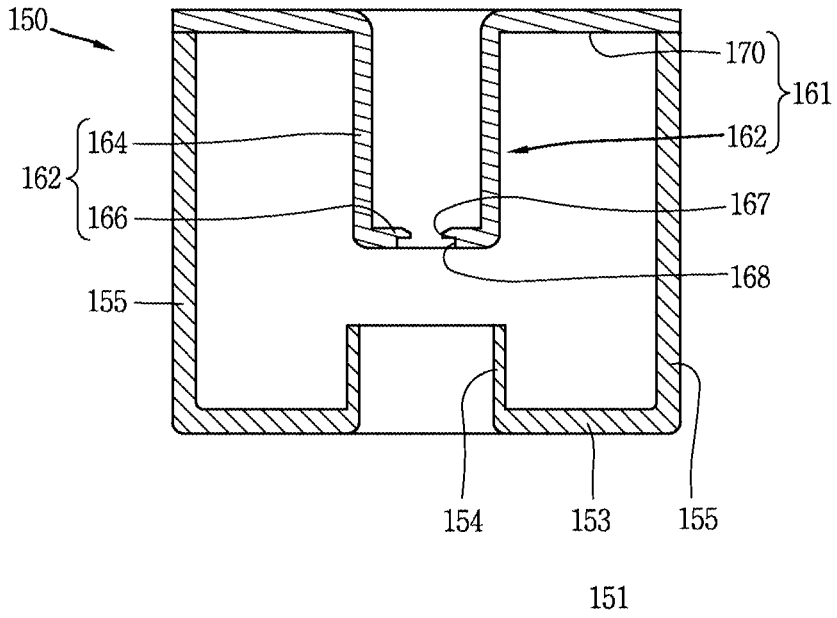
FIG. 4 is an enlarged view illustrating a yoke of FIG. 3.

As shown in FIG. 4, the first yoke 151 may have a U-shaped section.

The first yoke 151 may include a shielding portion 153 disposed at an end of the coil 141, and a side wall portion 155 bent from two ends of the shielding portion 153 and disposed at an outer circumferential surface of the coil 141.

A movable core guiding portion 154, configured to guide the movable core 180 disposed in the shielding portion 153, may be provided in the shielding portion 153.

The movable core guiding portion 154 may be formed to have a shape corresponding to an external shape of the movable core 180, and may guide the movable core 180 and form a magnetic path together with the movable core 180.

The movable core guiding portion 154 may be provided in a cylindrical shape.

The inner section 162 may be provided in a hollow cylindrical shape.

The inner section 162 may include a cylindrical portion 164, and a shielding portion 166 to shield one end of the cylindrical portion 164.

A through hole 167 may be provided at the inner section 162 such that the shaft 190 is relative-movably inserted into the inner section 162 there through.

The through hole 167 may be provided to penetrate the shielding portion 166.

The connection section 170 may be provided at an end portion of the cylindrical portion 164 to extend in a radius direction.

The connection section 170 may be provided in a rectangular plate shape.

The connection section 170 may include an opening portion at a central part thereof.

The inner section 162 may be provided at one side of the opening portion of the connection section 170.

The opening portion of the connection section 170 may be formed to communicate with the inner section 162. Thus, the shaft 190 may be inserted into the inner section 162 through the opening portion.

Meanwhile, the housing 110 may be configured to have an open side.

More specifically, the housing 110 may be configured to be open toward the driving unit 130.

The second yoke 161 may be disposed at the opening portion of the housing 110.

The connection section 170 may be disposed at the opening portion of the housing 110.

The opening portion of the housing 110 may be closed by the second yoke 161, and thus discharge of an arc generated between the fixed contact 111 and the movable contact 121 can be prevented.

The side wall portion 155 of the first yoke 151 may be connected to the connection section 170 of the second yoke 161. Thus, the second yoke 161 and the first yoke 151 may be magnetically connected to each other. Under such a configuration, a magnetic line is generated by the coil 141 when a power is applied to the coil 141, and may flow through the first yoke 151, the second yoke 161, and the movable core 180, sequentially. In such a state, the movable core 180 may be moved toward the second yoke 161 by a magnetic attractive force of the inner section 162 of the second yoke 161.

The movable core 180 may be made of a magnetic material.

The movable core 180 may be formed in a circular bar shape.

The shaft 190 may be connected to the movable core 180.

The shaft 190 and the movable core 180 may be coupled to each other by an assembling method, to thereby omit a welding process so that a prompt and easy coupling work can be performed.

Figure 5:
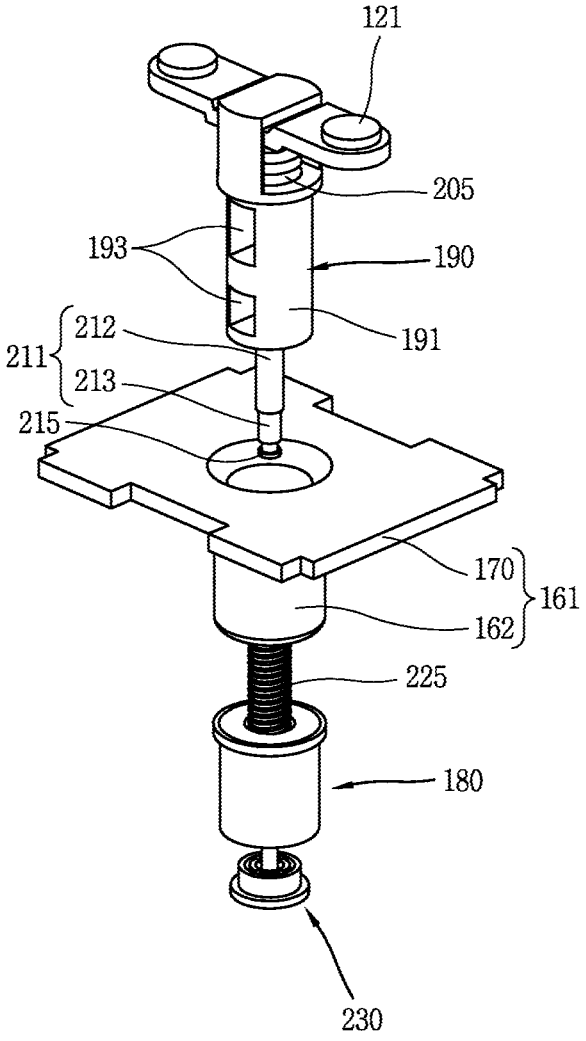
FIG. 5 is a perspective view illustrating a shaft, a second yoke, a movable core, and a fixing member of FIG. 3 in an unassembled state.
Figure 6:
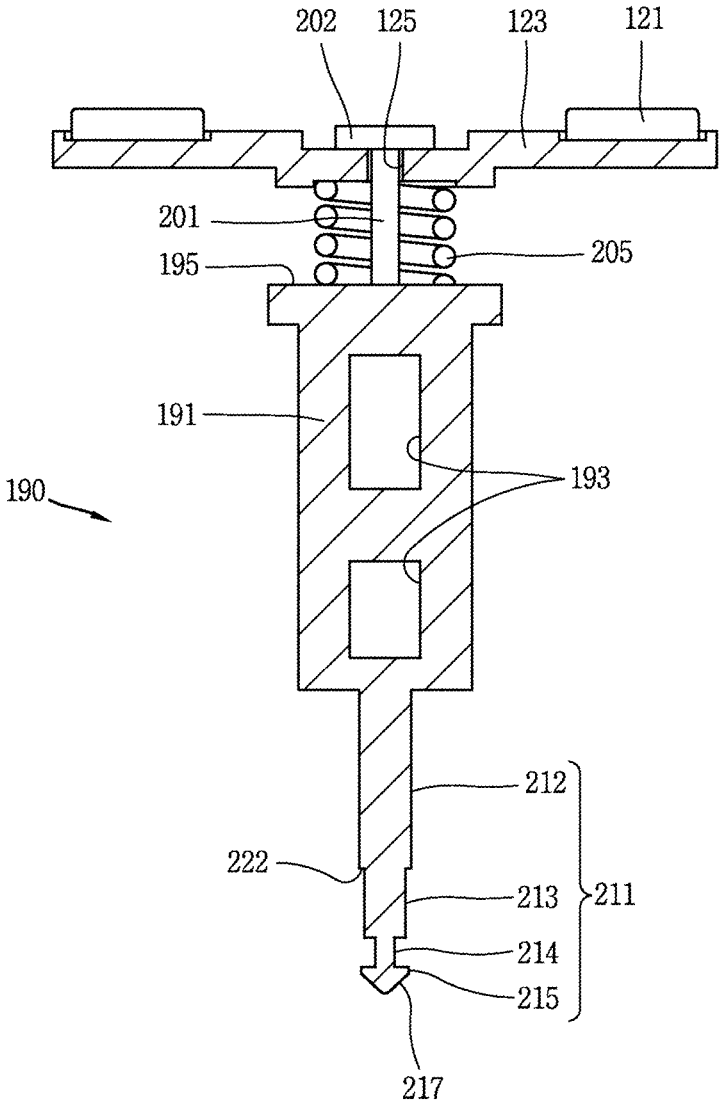
FIG. 6 is an enlarged view illustrating the movable contact and the shaft of FIG. 3.

As shown in FIGS. 5 and 6, for example, one end of the shaft 190 may be coupled to the movable core 180 and the other end of the shaft 190 may be coupled to the movable contact 121.

The shaft 190 may be made of, for example, a synthetic material. Thus, the weight of the shaft 190 can be remarkably reduced, when compared to the conventional shaft which is made of metal for welding. Further, a moving speed of the movable contact 121 can be relatively increased, when compared to the conventional one in a case where the same magnetic force is formed.

The shaft 190 may include a shaft body 191, a movable contact coupling portion 201 formed at one end of the shaft body 191 and to which the movable contact 121 is coupled, and a coupling portion 211 formed at another end of the shaft body 191 and to which the movable core 180 is coupled.

The shaft body 191 may be configured to have a relatively large diameter.

The shaft body 191 may be configured in a circular rod shape so as to be movable with respect to the inner surface of the inner section 162.

A space portion 193 may be formed at the shaft body 191 by cutting-out or removing part of the shaft body 191 so that a weight of the shaft body 191 can be reduced. In this embodiment of the present invention, although the space portion 193 is formed to penetrate through the shaft body 191, the space portion 193 may be configured on an outer surface of the shaft body 191 in the form of a recess concaved by a predetermined depth.

The movable contact coupling portion 201 may be configured to have a smaller outer diameter than the shaft body 191.

The movable contact coupling portion 201 may be coupled to the connection portion 123 of the movable contact 121 to be relatively movable with respect thereto.

Figure 7:
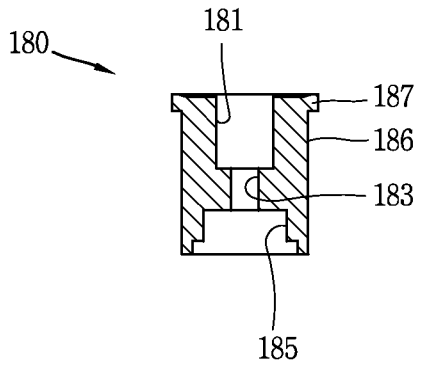
FIG. 7 is an enlarged view illustrating the movable core of FIG. 3.

As shown in FIG. 7, the movable contact coupling portion 201 may be disposed to be in contact with an outer surface of the movable contact 121 and include a movable contact support portion 202.

A compression spring 205 may be provided around the movable contact coupling portion 201.

One end of the compression spring 205 may be in contact with the movable contact 121 and the other end thereof may be in contact with the shaft body 191. Under such a configuration, when the shaft body 191 is moved toward a contact position, the compression spring 205 pressed by the shaft body 191 is compressed and, thereby the movable contact 121 may be elastically compressed. Thus, the movable contact 121 may be maintained in a contact state with a predetermined compression force.

A compression spring support portion 195 may be provided at the shaft 190 to support the compression spring 205.

The compression spring support portion 195 may have a larger outer diameter than the compression spring 205.

The compression spring support portion 195 may be formed at an end of the shaft body 191. The compression spring support portion 195 is formed to have a planar surface in this embodiment. However, the compression spring support portion 195 may be configured as a recess in which an end of the compression spring 205 is inserted or a protrusion which is inserted into the compression spring 205. Between the compression spring 205 and the compression spring support portion 195, a washer (not shown) may be provided.

In this embodiment of the present invention, the compression spring support portion 195 has an outer diameter larger than that of the shaft body 191 to extend outward in a radius direction of the shaft body 191. However, the compression spring support portion 195 may be formed to have the same diameter as that of the shaft body 191.

The coupling portion 211 may have a smaller outer diameter than the shaft body 191.

The coupling portion 211 may be formed to penetrate through the movable core 180.

One end of the coupling portion 211 may be exposed outward through the movable core 180.

A fixing member 230 may be provided at the exposed end of the coupling portion 211 in order to prevent the coupling portion 211 from being separated from the movable core 180.

As shown in FIG. 7, an insertion portion 183 may be provided at an end of the movable core 180, so that the coupling portion 211 may be inserted there through.

A fixing member insertion portion 185 may be provided at an end of the movable core 180, so that the fixing member 230 may be inserted and coupled there through. Under such a configuration, an axial length of the shaft 190 can be reduced and thus, the size of the electromagnetic relay can be minimized. Further, since the axial length of the movable core 180 may be increased, the shaft 190 and the movable core 180 coupled to each other can be stably operated.

The fixing member insertion portion 185 may be formed at an end (a lower end in the drawing) of the movable core 180. The fixing member insertion portion 185 may be formed to have a depth large enough for a lower end of the movable core 180 and a lower end of the fixing member 230 to be on the same plane when the fixing member 230 is inserted therein.

A yoke contact portion 186 may be provided on an external surface of the movable core 180.

The movable core 180 may be provided with an extension portion 187 in a radius direction to extend its surface area in correspondence to the inner section 162.

Between the movable core 180 and the inner section 162, a restoration spring 225 may be provided to return the movable core 180 to its initial position.

The initial position means a position where the movable contact 121 is separated from the fixed contact 111 for insulation.

The restoration spring 225 may be coupled around the coupling portion 211.

A restoration spring accommodating portion 181 may be provided at the movable core 180 to accommodate one end (a lower end in the drawing) of the restoration spring 225 therein.

A restoration spring support portion 168 may be provided at an end of the inner section 162 of the second yoke 161 to support the other end (an upper end in the drawing) of the restoration spring 225.

The restoration spring support portion 168 may be formed in a concave manner at the shielding portion 166 of the inner section 162.

A hook 215 may be provided at an end of the coupling portion 211.

The hook 215 may be formed to be exposed outwardly through a lower end of the movable core 180.

An engaging portion 220 may be provided at a predetermined portion of the shaft 190 and the movable core 180 to restrict an insertion depth of the coupling portion 211 of the shaft 190.

The engaging portion 220 may restrict an exposed range of the hook 215 by being engaged with each other in an axial direction of the shaft 190.

The engaging portion 220 may include a hooking portion 222 formed in a stepped manner in a radius direction of the coupling portion 211, and a hooking jaw 224 which contacts the movable core 180 in an axial direction of the hooking portion 222 to restrict insertion of the hooking portion 222.

More specifically, the coupling portion 211 of the shaft 190 may include a first diameter section 212, a second diameter section 213 having a smaller diameter than the first diameter section 212, and a hooking portion 222 formed at an interface between the first diameter section 212 and the second diameter section 213.

The insertion portion 183 may have a smaller diameter than the restoration spring accommodating portion 181.

The insertion portion 183 of the movable core 180 may have an inner diameter corresponding to the second diameter section 213 of the coupling portion 211 of the shaft 190.

A hooking jaw 224 may be formed at an interface between the restoration spring accommodating portion 181 and the insertion portion 183.

The fixing member 230 may include a hook locking jaw 235 engaged with the hook 215.

Figure 8:
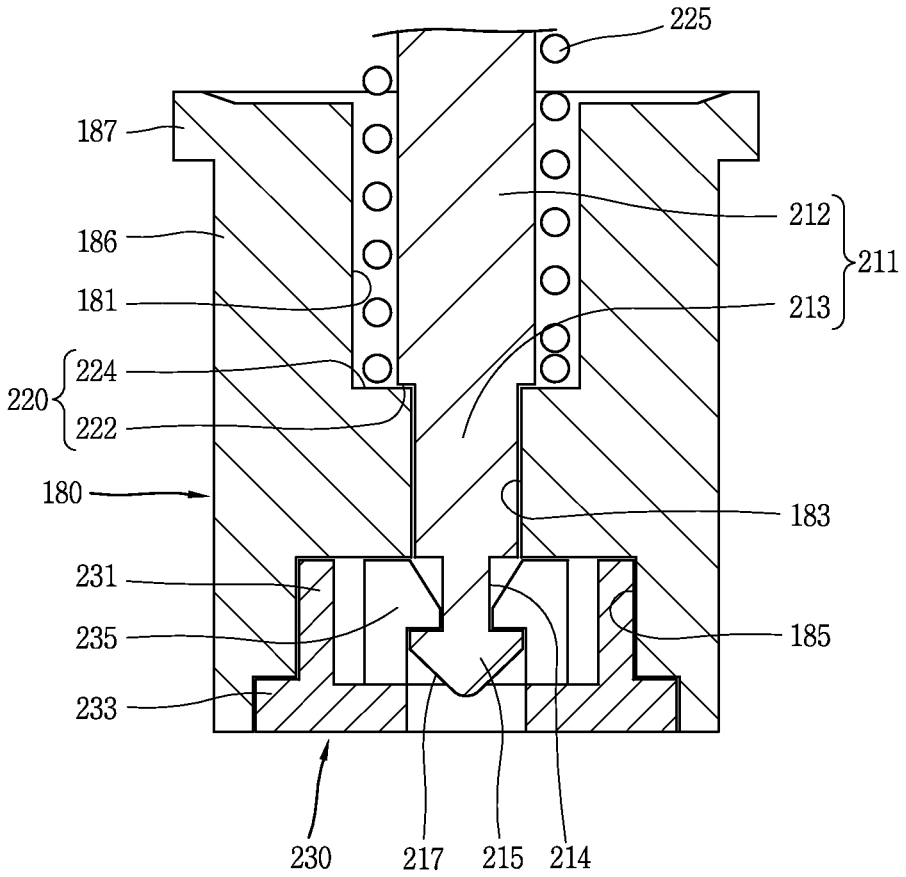
FIG. 8 is an enlarged view illustrating the movable core and the fixing member of FIG. 3 in an assembled state.
Figure 9:
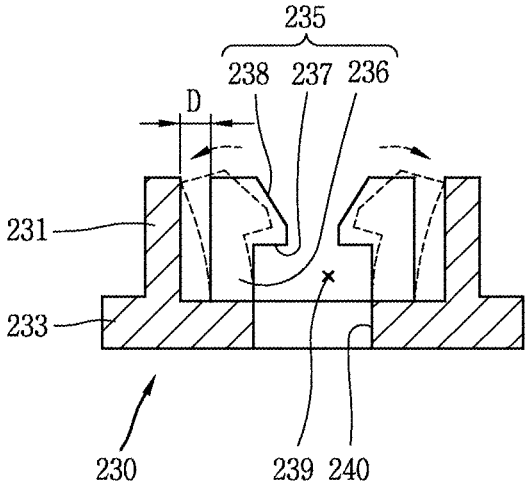
FIG. 9 is an enlarged view illustrating the fixing member of FIG. 3.

As shown in FIGS. 8 and 9, the fixing member 230 may include a cylindrical fixing member body 231, and a plurality of hook locking jaws 235 disposed within the fixing member body 231 in a circumferential direction.

The fixing member body 231 may have a through hole 240 at a center thereof.

The fixing member body 231 may include a flange 233 extended in a radius direction.

The hook locking jaw 235 may be provided in plurality in number.

The hook locking jaw 235 may be provided, for example, in four.

The hook locking jaw 235 may be formed to protrude inward along a radius direction to be engaged with the hook 215 in an axial direction.

The hook locking jaw 235 may be elastically transformed when engaged with the hook 215.

As shown in FIG. 9, the hook locking jaw 235 may have a predetermined gap 'D' from the fixing member body 231 to avoid any interference with an inner surface of the fixing member body 231, in a case where the hook locking jaw 235 is elastically transformed outward when engaged with the hook 215.

More specifically, the hook locking jaw 235 may include a hook locking jaw body 236 which is formed at an inner side of the fixing member body 231 in an axial direction, and a hooking jaw portion 237 formed at an end portion of the hook locking jaw body 236 to protrude inward in a radius direction.

Each of the hook locking jaws 235 may include an inclined surface 238.

The inclined surface 238 may be formed to be inclined outward with respect to the hooking jaw portion 237.

Thus, the hook locking jaw 235 may smoothly contact the inclined surface 238 when coupled with the hook 215.

The hooking jaw portion 237 may be in surface-contact with the end of the hook 215 in an axial direction to restrict a relative movement, thereby preventing the hook 215 from being separated from the hook locking jaws 235.

A hook accommodating portion 239 may be provided at an inner side of the hook locking jaws 235 to accommodate therein the hook 215.

The hook accommodating portion 239 may be configured to communicate with outside through the through hole 240.

A hook locking jaw accommodating portion 214, configured to accommodate part of the hook locking jaw 235 therein, may be provided at one side of the second diameter section 213.

More specifically, the hook locking jaw accommodating portion 214 may be configured to accommodate therein an end portion of the hooking jaw portion 237 of the hook locking jaw 235, as shown in FIGS. 7 and 8.

The hook locking jaw accommodating portion 214 may be provided between the hook 215 and the second diameter section 213.

Under such a configuration, the shaft 190 may be inserted into the inner section 162 of the second yoke 161 through the opening portion.

The restoration spring 225 may be provided around the inner section 162 of the second yoke 161.

When the shaft body 191 is inserted into the inner section 162 of the second yoke 161, the coupling portion 211 of the shaft body 191 may protrude to outside of the inner section 162 by passing through the through hole 167.

The end of the coupling portion 211 of the shaft body 191, which has passed through the inner section 162, may be inserted into the restoration spring 225.

Upon continuous insertion of the shaft 190, the coupling portion 211 of the shaft 190 may be inserted into the insertion portion 183 of the movable core 180.

Once the shaft 190 is continuously inserted into the inner section 162, the hooking portion 222 contacts the hooking jaw 224, and thus the movement of the shaft 190 may be restricted.

At this moment, the hook 215 may protrude toward the fixing member insertion portion 185 after having passed through the insertion portion 183.

The fixing member 230 may be fixed to the hook 215.

More specifically, when inserting the fixing member 230 into the fixing member insertion portion 185 of the movable core 180, each hook locking jaw 235 of the fixing member 230 is compressed by the inclined surface 217 of the hook 215 and then elastically transformed to be outward widened in a radius direction.

In this embodiment, the fixing member 230 is inserted into the movable core 180 after the shaft 190 has been inserted into the movable core 180, as an example. However, the fixing member 230 may be firstly inserted into the movable core 180, and then the shaft 190 may be inserted into the movable core 180.

Upon completion of the insertion of the fixing member 230, each hook locking jaw 235 of the fixing member 230 returns to its initial position by its elasticity so that an end of the hook 215 and the hooking jaw portion 237 of the hook locking jaw 235 become surface-contact with each other, thereby restricting separation of the shaft 190 from the movable core 180.

The restoration spring 225 may apply an elastic force to the movable core 180 to separate the movable core 180 from the inner section 162 of the second yoke 161, by the elastic force accumulated while the restoration spring 225 is compressed when the shaft 190 is coupled with the movable core 180.

As described above, according to an embodiment of the present invention, as the shaft and the movable core may be coupled to each other in a simple assembling manner, an assembling process can be facilitated and the production cost can be reduced.

Further, the shaft and the movable core can be rapidly and easily coupled to each other by eliminating a welding process.

Further, the shaft and the movable core can be rapidly and easily coupled to each other by providing the hook at an end of the shaft and the fixing member at an end of the moving core for engagement with each other.

Further, since the engaging portions are provided at the shaft and the movable core, additional equipment for maintaining a stroke between the fixed core and the movable core when coupling the shaft to the movable core is not required so that the production cost can be reduced.

Further, the weight of the electromagnetic relay can be reduced by eliminating the use of a circular rod shaped fixed core and by providing the shaft formed of a synthetic resin material.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic relay, comprising:
- a housing;
- a fixed contact provided within the housing;
- a movable contact configured to be movable between contacting the fixed contact and separated from the fixed contact; and
- a driving unit configured to drive the movable contact between contacting the fixed contact or separated from the fixed contact, wherein the driving unit comprises:
- a coil;
- a yoke disposed within the coil and comprising an inner section for forming a magnetic path inside and outside of the coil;
- a movable core disposed within the coil to be attractable by the inner section;
- a shaft comprising:
  - a shaft body; and
  - one end connected to the movable core and another end connected to the movable contact, wherein a coupling portion is provided at the one end and coupled with the movable core; and
- a fixing member configured to be coupled to an end of the coupling portion which is exposed outside of the movable core, wherein the fixing member is configured to restrict separation of the coupling portion from the movable core, wherein:
- a hook is provided at the end of the coupling portion,
- a hook locking jaw is provided at the fixing member and configured to be engaged with the hook in an axial direction, and the coupling portion comprises:
- a first diameter section extending from an end of the shaft body;
- a second diameter section formed adjacent to the first diameter section and having a smaller diameter than the first diameter section; and
- a hook locking jaw accommodating portion adjacent to the second diameter section and configured to accommodate the hook locking jaw.

2. The electromagnetic relay of claim 1, wherein the hook locking jaw is further configured to be elastically transformed when the hook locking jaw is coupled to the hook.

3. The electromagnetic relay of claim 2, wherein the fixing member comprises:
- a cylindrical fixing member body, and
- a plurality of hook locking jaws disposed along a circumference within the cylindrical fixing member body.

4. The electromagnetic relay of claim 1, wherein the shaft and the movable core comprise corresponding engaging portions configured to restrict an exposed amount of the hook.

5. The electromagnetic relay of claim 4, wherein the engaging portion of the shaft comprises a hooking portion and the engaging portion of the moveable core comprises a hooking jaw, and wherein the corresponding engaging portions are configured to be engaged in an axial direction.

6. The electromagnetic relay of claim 3, wherein the hook locking jaw comprises a hook accommodating portion configured to accommodate the hook.

7. The electromagnetic relay of claim 6, wherein the fixing member body includes a through hole configured to be in communication with the hook accommodating portion.

8. The electromagnetic relay of claim 3, wherein the movable core comprises a fixing member insertion portion configured to accommodate the fixing member.

9. The electromagnetic relay of claim 8, wherein the fixing member body comprises a flange extended outwardly along a radial direction.

10. The electromagnetic relay of claim 1, wherein the shaft is made of a synthetic resin material.

11. The electromagnetic relay of claim 10, wherein:

the movable contact and the shaft are coupled to each other and configured to be movable with each other, the shaft comprises a compression spring configured to provide an elastic force to the movable contact when contacting the fixed contact, and the shaft further comprises a compression spring support portion configured to support the compression spring.

12. The electromagnetic relay of claim 10, wherein the shaft comprises a void at a body of the shaft.

13. The electromagnetic relay of claim 1, wherein the yoke comprises:

a first yoke disposed outside the coil to form a magnetic path; and a second yoke including a connection section configured to connect the inner section to the first yoke.

14. The electromagnetic relay of claim 13, wherein a restoration spring is provided between the inner section of the second core and the movable core and configured to bias the movable core to its initial position, and wherein the inner section comprises a restoration spring support portion configured to support an end of the restoration spring.

15. The electromagnetic relay of claim 14, wherein the inner section further comprises a cylindrical portion comprising a receiving space and a shielding portion configured to shield an end of the cylindrical portion, and wherein the restoration spring support portion is concave and is provided on the shielding portion.

16. The electromagnetic relay of claim 14, wherein the first yoke is configured in a U-shape, and wherein the first yoke comprises:

a shielding portion disposed at an end of the coil in an axial direction, and side wall portions angularly extending from ends of the shielding portion and disposed at an outer circumferential surface of the coil.

17. An electromagnetic relay, comprising:

a housing;

a fixed contact provided within the housing;

a movable contact configured to be movable between contacting the fixed contact and separated from the fixed contact; and a driving unit configured to drive the movable contact between contacting the fixed contact or separated from the fixed contact, wherein the driving unit comprises:

a coil;

a yoke disposed within the coil and comprising an inner section for forming a magnetic path inside and outside of the coil;

a movable core disposed within the coil to be attractable by the inner section;

a shaft comprising:

a shaft body; and one end connected to the movable core and another end connected to the movable contact, wherein a coupling portion is provided at the one end and coupled with the movable core; and a fixing member configured to be coupled to an end of the coupling portion which is exposed outside of the movable core, wherein the fixing member is configured to restrict separation of the coupling portion from the movable core, wherein:

a hook is provided at the end of the coupling portion, a hook locking jaw is provided at the fixing member and configured to be engaged with the hook in an axial direction, and the coupling portion comprises:

a first diameter section extending from an end of the shaft body; and a second diameter section formed adjacent to the first diameter section and having a smaller diameter than the first diameter section;

wherein the shaft and the movable core comprise corresponding engaging portions to restrict an exposed range of the hook, and wherein the engaging portion of the shaft comprises a hooking portion and the engaging portion of the moveable core comprises a hooking jaw, and the corresponding engaging portions are configured to be engaged in an axial direction.

* * * * *